US006308407B1

(12) United States Patent
Graf et al.

(10) Patent No.: US 6,308,407 B1
(45) Date of Patent: Oct. 30, 2001

(54) METHOD OF MANUFACTURING A PLURALITY OF STEAM TURBINES FOR USE IN VARIOUS APPLICATIONS

(75) Inventors: Peter Graf, Küssaberg (DE); Maurus Herzog, Schinznach Dorf; Pierre Meylan, Neuenhof, both of (CH); Harald Römer, Darmstadt (DE)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/458,701

(22) Filed: Dec. 13, 1999

(30) Foreign Application Priority Data

Dec. 16, 1998 (EP) ..... 98 811 231

(51) Int. Cl.[7] ..... B21K 25/00
(52) U.S. Cl. ..... 29/889.2; 29/889; 29/401.01
(58) Field of Search ..... 29/889.1, 889.2, 29/401.01, 889; 415/912

(56) References Cited

U.S. PATENT DOCUMENTS

| | | |
|---|---|---|
| 4,812,107 | 3/1989 | Barcella et al. . |
| 4,881,872 | 11/1989 | Bütikofer et al. . |
| 4,979,873 | 12/1990 | Bertilsson . |
| 5,342,169 | 8/1994 | Müller . |
| 5,465,482 | 11/1995 | Elvekjaer et al. . |
| 5,520,512 | 5/1996 | Walker et al. . |

FOREIGN PATENT DOCUMENTS

| | | |
|---|---|---|
| 24 08 641 | 8/1975 | (DE) . |
| 44 25 352 | 1/1996 | (DE) . |
| 138070 | 9/1920 | (GB) . |
| 918522 | 2/1963 | (GB) . |
| 86/06790 | 11/1986 | (WO) . |

*Primary Examiner*—I Cuda Rosenbaum
(74) *Attorney, Agent, or Firm*—Burns, Doane, Swecker & Mathis, L.L.P.

(57) ABSTRACT

In a method of manufacturing a plurality of steam turbines for use in various applications which differ in the respective thermodynamic parameters such as, for example, cooling-water temperature, ambient temperature, given boiler data, process-steam requirement, etc., the steam turbines in each case having at least one high-pressure part with first blading and a control-wheel stage for part-load operation, a simplification and cost saving is achieved owing to the fact that standard blading, which is identical for all the steam turbines, is used as first blading, and in that the adaption of the individual steam turbine to the thermodynamic parameters of the respective application is carried out by appropriate design or variation of the control-wheel stage.

12 Claims, 1 Drawing Sheet

METHOD OF MANUFACTURING A PLURALITY OF STEAM TURBINES FOR USE IN VARIOUS APPLICATIONS

BACKGROUND OF THE INVENTION

1. Field of the Invention

The invention relates to the technological field of steam turbines. It relates to a method of manufacturing a plurality of steam turbines for use in various applications which differ in the respective thermodynamic parameters such as, for example, cooling-water temperature, ambient temperature, given boiler data, process-steam requirement, etc., the steam turbines in each case having at least one high-pressure stage with first blading and a control-wheel stage for part-load operation.

2. Background of the Invention

In the manufacture of steam turbines, which may exist as individual high-pressure (HP) machines or as combined high-pressure/intermediate-pressure (HPIP) machines, the blading of the high-pressure and/or intermediate-pressure part, in the event of an order being placed, is designed individually to the data required or specified for the respective application. This also includes—if there is a control-wheel stage for part-load operation—the individual design of the control-wheel stage with respectively adapted duct height (of the wheel duct) and an adapted number of wheel blades or nozzles arranged in an annular shape upstream of the control wheel in the direction of flow (for details of such control-wheel stages, reference may be made, for example, to publications U.S. Pat. No. 4,812,107, U.S. Pat. No. 4,881,872 and U.S. Pat. No. 4,979,873).

The result of this individual adaptation of the steam turbine is that, with each order, new customer-specific production documents have to be prepared for the entire blading including the small accessories and the control-wheel stage. A repetition effect during the production, of the control wheel too, is thus largely ruled out. This procedure certainly has the advantage that any customer-specific variation within the blading can be realized with the existing design tools. A disadvantage, however, is that possible cost-saving potentials are very small and are restricted to fine design details permitted by the existing design tools.

SUMMARY OF THE INVENTION

Accordingly, one object of the invention is to provide a novel method with which steam turbines can be manufactured for different applications and different thermodynamic parameters in a simple manner and with a high proportion of cost-saving standard components.

One of the objectives of the present invention consists in combining fixed standard blading in the high-pressure stage with a control-wheel stage varying in design from application to application, in order to adapt the steam turbine to the respective thermodynamic parameters of the application (e.g. condenser vacuum (cooling-water temperature), ambient temperatures, given boiler data of various manufactures, requisite process steam, etc.). The entire thermodynamic variability of the steam turbine is thus restricted to a single component (here the control-wheel stage), specifically both in terms of production and procurement. Since in particular the blading with the machining interface (turned recesses) at casing and shaft has an enormous simplification and cost-saving potential with regard to repetition effects, a considerable advantage is achieved by the standardization of the blading.

A first preferred embodiment of the method according to the invention is distinguished by the fact that the steam turbines in each case additionally have an intermediate-pressure part and a low-pressure part having second blading and third blading, and that standard blading likewise identical for all the steam turbines is used as second blading and third blading. By the use of such standard blading, an even greater simplification/saving is achieved in this case.

A second preferred embodiment of the method according to the invention is distinguished by the fact that the control-wheel stage has a control wheel sitting on the rotor and a plurality of nozzles arranged concentrically around the rotor axis, and that, in order to design the control-wheel stage, the control wheel and/or the nozzles are varied in their arrangement and/or configuration.

A preferred development of this embodiment is distinguished by the fact that the number of nozzles is varied and/or that the geometry of the individual nozzles is varied.

In another preferred development of this embodiment, the control wheel has a third blading variation, in which the wheel-blade geometry, in particular the blade-body thickness and/or the blade-body height and/or the curvature, is varied.

BRIEF DESCRIPTION OF THE DRAWINGS

Preferred embodiments of the invention is/are disclosed in the following description and illustrated in the accompanying drawings in which.

DETAILED DESCRIPTION OF THE INVENTION

Figure 1:
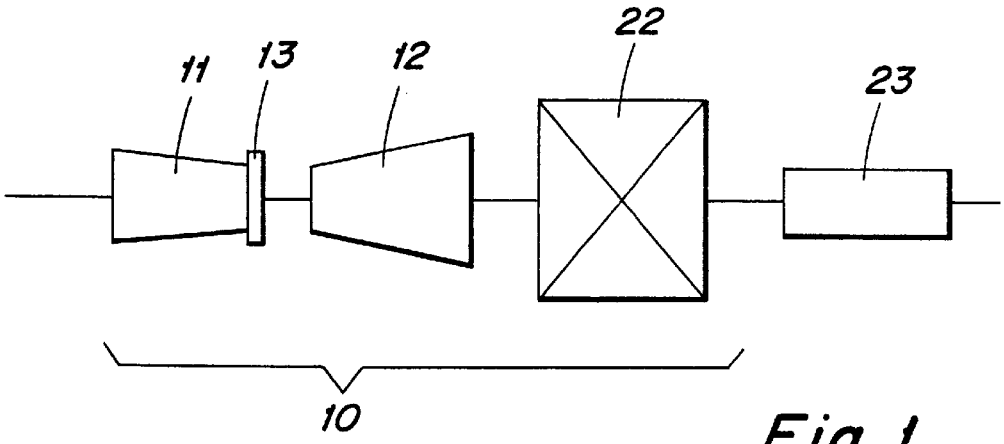
FIG. 1 shows the exemplary schematic arrangement of a turbogroup or steam turbine with connected generator and control-wheel stage in the high-pressure part, according to the present invention.

Referring to the drawings, wherein like reference numerals designate identical or corresponding parts throughout the several views, FIG. 1 shows an exemplary schematic arrangement of a turbogroup or steam turbine with connected generator and control-wheel stage in the high-pressure part, as is suitable for realizing the method according to the invention. In this example, the turbogroup or steam turbine 10 comprises a high-pressure part 11 with control-wheel stage 13, an intermediate-pressure part 12 and an (optional) low-pressure part 22. The steam turbine 10 drives a generator 23.

Figure 2:
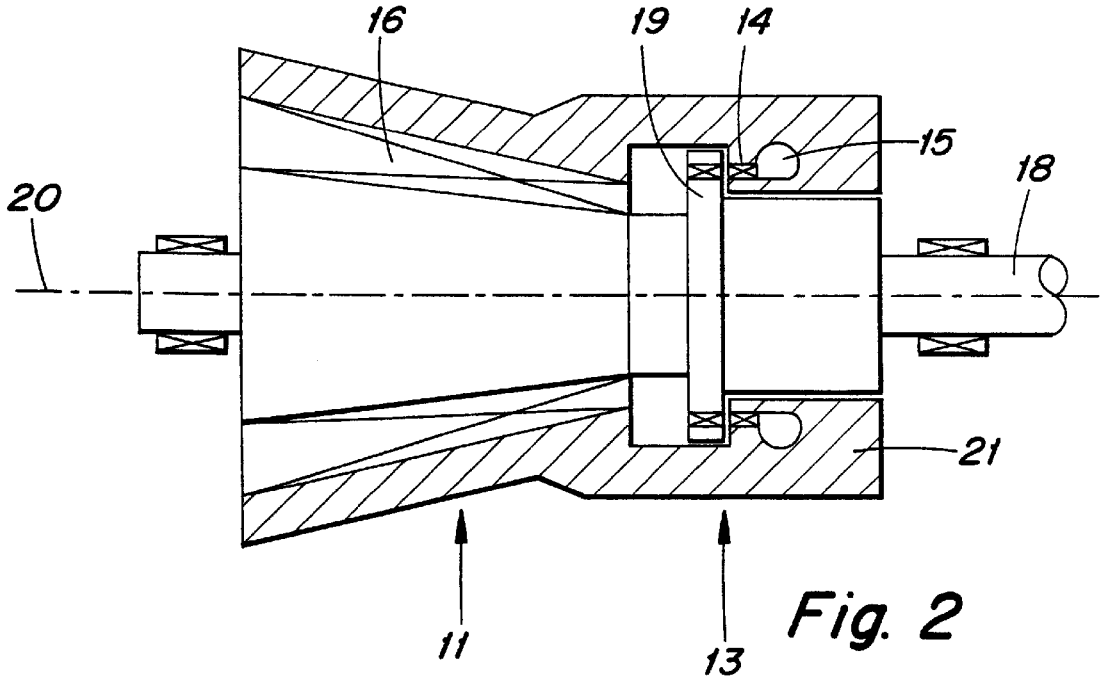
FIG. 2 is a side sectional view of the high pressure part according to the present invention.

FIG. 2 illustrates an exemplary embodiment of a high-pressure part 11 having blading 16 and a control-wheel stage 13 arranged upstream of the high-pressure part 11, the blading 16 and the control-wheel stage 13 being accommodated in a casing 21. The rotating parts are arranged on a common rotor 18, which rotates about a rotor axis 20. The control-wheel stage 13 contains a control wheel 19, which is equipped with separate blading (in this respect see, for example, U.S. Pat. No. 4,812,107) and to which steam is admitted from an inflow duct 15 via a ring of nozzles 14.

Within the scope of the invention, the blading 16 of the high-pressure part 11 and the blading of the intermediate-pressure part 12 in the steam turbine 10 is designed as standard blading, i.e. it is fixed for different applications having different thermodynamic parameters. In this case, the fixed standard blading means:

The geometry of the blade bodies and the shrouds is fixed and unchangeable.

The turned recesses for moving and guide blades are fixed and unchangeable.

The position of the bleed slots is fixed and unchangeable.

The number of stages and the number of blades per stage at the circumference are fixed and unchangeable.

The adaptation of the steam turbine 10 to the thermodynamic parameters of the respective application is restricted solely to the control-wheel stage 13. In this case, either the control wheel 19, the nozzles 14 or both may be adapted. In particular, a control-wheel stage 13 of variable design means (optionally):

The number of nozzles at the circumference per HP inflow sector is variable.

The nozzle and wheel-duct height is variable either in fixed steps or in an infinite manner.

The wheel-blade geometry of the control wheel 19 (body thickness and curvature) is variable.

The number of nozzles 14 may be varied in particular by dummy segments being inserted into individual segments or sectors of the nozzle arrangement. Furthermore, the stagger angle of the nozzle profiles may be varied. Finally, variation of the side-wall contours of the nozzles is also conceivable.

In the joint adaptation of control wheel 19 and nozzles 14, their conicity of their profile may also be varied in addition to the height.

On the whole, a manufacturing method which is distinguished by the following advantages is obtained with the invention:

Repetition effects are obtained for the entire blading during both procurement and production.

Repetition effects are obtained during the machining of the casing and the rotor. This is reflected in constant production documents (casting and machining drawings as well as parts lists) irrespective of the order.

The processing offers is simplified, quicker and thus more efficient.

Considerable total-cost savings compared with the prior art of about 30–40% in relation to the manufacturing costs result.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method of manufacturing a plurality of steam turbines, wherein said plurality of steam turbines have at least one high-pressure part with a first blading and a control-wheel stage for part-load operation, comprising:

using a standard blading, which is identical for the plurality of steam engines, as the first blading; and varying the control-wheel stage so as to adapt each of steam turbines to a thermodynamic parameter of a desired application.

2. The method as claimed in claim 1, providing each of the plurality of steam turbines with an intermediate-pressure part and a low-pressure part having a second blading and a third blading, respectively.

3. The method as claimed in claim 2, using standard blading as the second blading and the third blading.

4. The method according to claim 1, further comprising providing a control wheel for the control-wheel stage by placing the control wheel on a rotor of the turbine; and providing a plurality of nozzles concentrically around an axis of the rotor.

5. The method according to claim 4, further comprising varying an arrangement or configuration of the control wheel and/or the nozzles in order to design the control-wheel stage for a desired application.

6. The method according to claim 4, further comprising varying the number of nozzles.

7. The method according to claim 4, further comprising providing the nozzles over individual circular segments or sectors.

8. The method according to claim 7, further comprising varying the number of nozzles by using dummy segments.

9. The method according to claim 4, further comprising varying the geometry of each individual nozzle.

10. The method according to claim 4, further comprising designing the flow contours of the control wheel and the nozzles by defining limits on a hub side and cylinder side of the control wheel and the nozzles to form a flow duct.

11. The method according to claim 10, wherein the flow duct and nozzle have a height, and the method further comprises varying the height of the flow duct and nozzles.

12. The method according to claim 4, wherein the blading has a thickness, a height and/or a curvature, and the method further comprises varying the thickness, height and/or curvature of the blading.

* * * * *